US007681887B2

(12) United States Patent
Hensley

(10) Patent No.: US 7,681,887 B2
(45) Date of Patent: Mar. 23, 2010

(54) TARGET HANGER AND TARGET SUPPORT SYSTEM

(76) Inventor: Glenn Brant Hensley, 134 Quail Crossing Dr., Wake Forest, NC (US) 27587

( * ) Notice: Subject to any disclaimer, the term of this patent is extended or adjusted under 35 U.S.C. 154(b) by 0 days.

(21) Appl. No.: 12/102,265

(22) Filed: Apr. 14, 2008

(65) Prior Publication Data

US 2008/0272548 A1 Nov. 6, 2008

Related U.S. Application Data

(63) Continuation of application No. 11/229,866, filed on Sep. 19, 2005, now abandoned.

(60) Provisional application No. 60/611,741, filed on Sep. 22, 2004.

(51) Int. Cl.
*F41J 1/10* (2006.01)

(52) U.S. Cl. ..... 273/407; 273/380

(58) Field of Classification Search ..... 273/403–408; 211/113, 85, 29; 223/88, 95; D6/320
See application file for complete search history.

(56) References Cited

U.S. PATENT DOCUMENTS 1,611,397 A * 12/1926 Wells ..... 211/70.1
2,462,431 A * 2/1949 Schneider ..... 211/113
3,085,691 A * 4/1963 Smith ..... 211/119.12
3,592,343 A * 7/1971 Swett et al. ..... 211/123
4,767,012 A * 8/1988 Simmons ..... 211/89.01
5,265,737 A * 11/1993 Freeby ..... 211/30
5,396,994 A * 3/1995 Fitzgerald ..... 211/32
5,515,981 A * 5/1996 Gregory et al. ..... 211/113
D404,580 S * 1/1999 Hasler ..... D6/320
6,053,378 A * 4/2000 Doyel ..... 223/86
6,213,316 B1 * 4/2001 Gretz ..... 211/113
RE39,728 E * 7/2007 Dumplet ..... 223/1
7,341,767 B1 * 3/2008 Velinsky ..... 428/4
D566,405 S * 4/2008 Belokin ..... D6/315
2006/0220318 A1 10/2006 Law
2007/0013138 A1 1/2007 Hinnant
2007/0040334 A1 2/2007 Marshall et al.

OTHER PUBLICATIONS

MTM Bird Board, Cabela's World's Foremost Outfitter, 1996-2006 Cabela's Inc., http://www.cabelas.com/information/ HuntingOptics/ MTMBirdBoard.html.
Targetman Target Stand, Lyman Product's Targ-Dots, http://www.lymanproducts.com/lymanproducts/targdot.htm.
Sure-Site Double-postTarget Holder, The Sportsman's Guide, 2008 Spring, p. 49, Shooter's, So. St. Paul, MN.
Clay Target Rope Kit, The Sportsman's Guide, 2008 Spring, p. 49, Shooter's, So. St. Paul.

* cited by examiner

*Primary Examiner*—Mark S Graham
(74) *Attorney, Agent, or Firm*—Jim Passé; Passé Intellectual Property, LLC

(57) ABSTRACT

The present invention discloses novel hangers for hanging shooting targets such as clay targets in place for shooting practice. In addition it relates to a target system which includes hangers of the invention in combination with a horizontal support and optional support stands designed to hang one or more targets during target practice.

5 Claims, 3 Drawing Sheets

TARGET HANGER AND TARGET SUPPORT SYSTEM

CROSS REFERENCE TO RELATED APPLICATIONS

This application is a continuation of U.S. patent application Ser. No. 11/229,866, filed Sep. 19, 2005, now abandoned that was filed claiming priority to provisional Application No. 60/611,741, filed Sep. 22, 2004.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to target holders and target systems for target practice. In particular the present invention relates to a hanger for suspending a stationary target from a horizontal support and a horizontal target support system for hanging the hangers and targets on.

2. Description of Related Art

Gun and rifle target practice is not only a fun activity, it sharpens the aiming and shooting skills of the shooter. Targets come in all forms from sheets of paper with bulls-eye patterns to clay targets, balloons, "tin cans" and the like. Typically, the targets are nailed to walls, set on fences, clamped, taped, velcroed or even tossed up in the air. Practice with these forms of targets greatly improves skills for real life situations in addition to the general fun of target practice.

Current target mounting systems are not that good at retaining the targets and often times require that a particular location be used, for example, when sitting a target on a particular rock or post. These systems further suffer from the fact that repeated shooting can loosen or move stationary targets that are not fixed, thus requiring repeated rearranging of the targets to a proper position.

Accordingly, target holding systems that allow a broader range of uses in differing locations would be of great value to the target shooting community.

BRIEF SUMMARY OF THE INVENTION

The present invention relates to novel target hangers and a novel system for hanging targets for target practice with a variety of objects from paper targets to clay targets and the like. The vertical hanger allows hanging a wide variety of targets from a horizontal support like a rope or pole.

In one embodiment of the invention there is disclosed a hanger adapted to suspend a shooter's target from a horizontal support comprising:

a) an elongated shaft having a first end and a second end;

b) a horizontal support attachment means positioned at the first end for attaching the hanger to the horizontal support; and c) one or more target gripping means at the positions selected from the group consisting of along the shaft and at the second end of the hanger.

In yet another embodiment of the present invention, there is disclosed a system for supporting a target on a hard surface comprising:

a) a horizontal support having a first end and a second end; and b) at least one hanger for suspending a target from the horizontal support the hanger comprising:

i. an elongated shaft of unitary construction having a first end and a second end;

ii. a horizontal support attachment means positioned at the first end for attaching the hanger to the horizontal support; and iii. one or more target gripping means at the position selected from the group consisting of along the shaft and at the second end of the hanger.

In yet another embodiment of the invention, there is disclosed a hanger adapted to suspend from a horizontal support a clay target of the type cast by trap and skeet shooting equipment and displaying major surface circumscribed at the periphery thereof by a perpendicular lip, said hanger comprising:

a) an upper lobe adapted to interact with the horizontal support to suspend said hanger downwardly therefrom;

b) an elongated shaft having a first and second end, said shaft being attached at said first end thereof to said upper lobe; and c) a lower lobe of unitary construction rigidly attached to said second end of said shaft, said lower lobe comprising resilient means for gripping the lip of the clay target at a chosen location along the lip with a compressive force directed parallel to said shaft.

Other embodiments and differences in the performance of the present invention will be clearly seen from the detailed description and drawings which follow.

BRIEF DESCRIPTION OF THE DRAWINGS

FIG. 2*a* is a frontal view of a target holding system showing hangers, upright horizontal support and shooters targets, while

DETAILED DESCRIPTION OF THE INVENTION

Figure 1A:
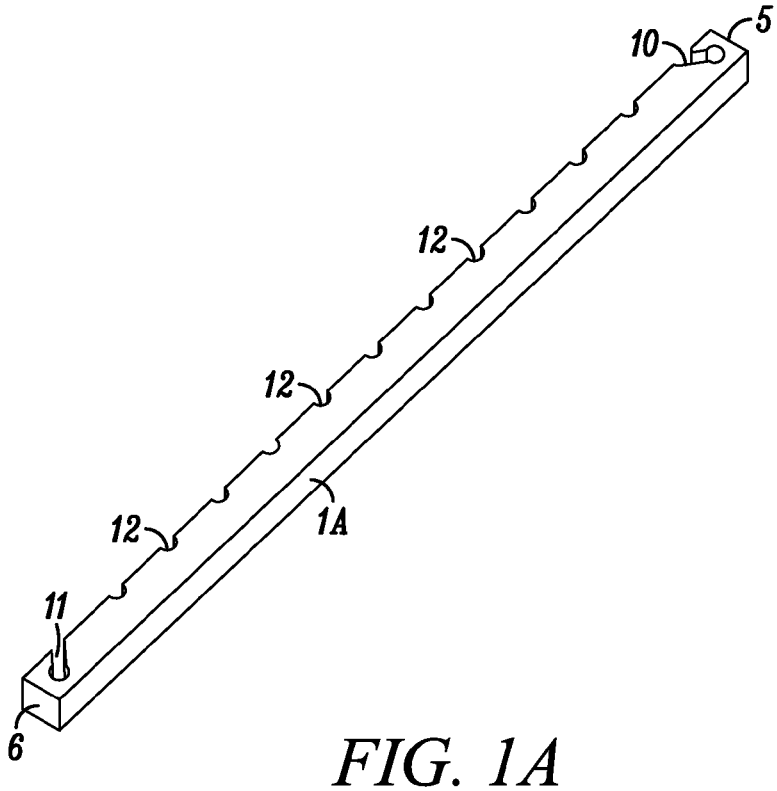
FIGS. 1*a* through 1*e* are various perspective embodiments of hangers of the invention.

It has been discovered that a new type of target hanger allows the support of one or more targets such as clay disks to be supported from a horizontal support such as a rope or rod. The hanger is an essentially rigid device either of unitary construction or parts rigidly attached to one another with a support attachment means and one or more target hanging means. Thus, a target support system can be assembled which allows for a plurality of targets being hung from the horizontal support by the hangers.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar and/or corresponding parts and described in the several views of the drawings. This detailed description defines the meaning of the terms used herein and specifically describes embodiments in order for those skilled in the art to practice the invention.

The terms "a" or "an", as used herein, are defined as one as or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "and an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

As used herein a shooter's target refers to items used for gun target practice. Typical items intended herein would include clay targets, cans, balloons, paper targets and the like. Other target materials are well known and can be considered a shooter's target.

As used herein the phrase "horizontal support" refers to rigid and flexible rods and rod like devices. These types of devices would include rope, (especially a taut rope), plastic rods, wooden dowel rods, metal pipe, metal cable and the like. In one embodiment, the horizontal support is made of a material that does not resist being pierced by a bullet and thus would reduce the probability of a ricochet if struck by a bullet. Materials such as rigid and soft plastics, wood, wood products, natural and synthetic cordage and the like are intended. The diameter of such horizontal supports can be from a few millimeters to an inch or more depending on the hanger and the type of target being used. In one embodiment, the diameter is between a sixty-fourth and one inch in diameter. The length of the horizontal support depends on the support itself and the means used to support the first and second ends of the horizontal support. For example, when the horizontal support is a rope, very short or very long lengths can be used and the ends of the rope either tied to uprights or tied to any convenient support that is rigid enough to suspend the rope off the ground. This could be stands, poles in the ground, stakes or could be objects like trees or the like. Tension can be applied to the rope to keep it taut or in other embodiments, it could be left hanging loose. Rigid plastic rods that are hung horizontally can tend to sag under the weight applied to the center if they are not sufficiently thick or rigid. While they can be supported at the first and second end, they will tend to function better in the present invention when made relatively shorter. In one embodiment, using cordage of various selected lengths, for example, 10 feet, 25 feet, 50 feet or the like could be used for the horizontal support. Horizontal rigid rods can likewise be any length, but in some embodiments they are 1 or 2 or 3 or 4 or 5 or 10 feet in length. In one embodiment, there is one more additional horizontal support means positioned above or below the first horizontal support. These additional support means can be used to hang additional hangers or to attach a second end of a hanger.

A hanger as used herein refers to a device for attaching to the horizontal support at one end, hanging downwardly from the horizontal support and attaching one or more targets to the hanger along the shaft of the hanger or at a second end of the hanger. Attachment means to the horizontal support can be provided at both the first end and second end so that the hanger can be suspended at either end to attach or reattach to the horizontal support. This dual attachment means can be useful not only to orient the device with its initial use, but also is useful in circumstances where the hanger has been shorn or sheared from its original assembly because the end attached to the horizontal support has been shot off. In this circumstance, the hanger can be turned upside down and reattached to the horizontal support instead of being thrown away. The horizontal support attachment means can be any system useful for attaching to the horizontal support such as adhesive tape, glue, twine, an open hook or can be a hole in which the horizontal support can be threaded through, for example, in the case of a rope. The open hook or slot type attachment means has the advantage of not needing to be rethreaded from the beginning of the horizontal support means in the event a hanger needs to be reattached during use of the system of the invention as would be the case for a hole attachment means. Other designs of a hanger can be also determined from the description herein and is within the scope of the present invention.

In one embodiment, the hanger is adapted to suspend a clay target (also called a clay pigeon) from the horizontal support of the type cast by trap and skeet shooting equipment such that it displays a major surface of the clay target circumscribed at the periphery of the clay target's perpendicular lip.

A hanger consists of an elongated shaft. The length of the shaft is determined by the number of target attachment sites desired on the hanger in general, but, the number of desirable sites can be readily determined by one skilled in the art. For example, with one horizontal support attachment means and one target hanging means the hanger can be about 2 to 5 inches in length. Where a multiplicity of target attachment sites are on the hanger the hanger could be 6 or 12 or 18 inches or longer. The hanger will have two ends, a first end and a second end. In at least one end as described above there will be a horizontal support attachment means. Along the shaft and/or at the second end of the hanger are one or more positions (notches, for example) that are target gripping means for attaching a target to the hanger in a removable manner. These can be c-shaped openings in the shaft that can be positioned perpendicular to the shaft or at any angle as desired. A horizontal c-shape could, for example, hold a clay target so that the face of the clay target will be perpendicular to the ground and face a shooter or marksman if the c is perpendicular to a vertical shaft and the clay target has a perpendicular lip. The c can be of a size that it forms a compressive force on the target it holds or of a size that the target just fits into the c and is held in place by gravity, friction or the like. There could also be an angle to the c-opening to aid in gravity holding the target, and likewise, integrated teeth of some kind can be used to grip a target.

The hanger is made of materials such as metals, polymers, rubbers, resins, fibers, wood products or the like. These materials that when struck by a bullet will break, be punctured, spin or yield to the force of the bullet and not induce the bullet to ricochet. It can be made of a single unitary material or it can be two or more pieces rigidly attached to each other. Rigid or rigidly attached means that it retains a degree of stiffness and can be entirely rigid or have some degree of flexibility sufficient to hold a selected target. So, for example, the horizontal support means could be attached at one end of the hanger shaft. In addition, if the hanger is made of a resilient polymer it can be shaped to create and provide a compressive force to hold a target in the target gripping means. The exact shape can vary, so in some embodiments the hanger is a rectangular or rod shape while in others it could have enlargements such as lobes at one or more ends to accommodate the horizontal support. The hanger can be made by any convenient means such as molding, extrusion, stamping, laser cutting, carving or the like. In most instances, lower cost might be considered more important than looks in manufacturing the hanger, since it is likely to be frequently damaged during use.

The system of the present invention comprises a hanger and a horizontal support as described above. In one embodiment of the system, there is also included a pair of uprights for supporting the first and second end of the horizontal support. The upright could be a shaft having an upper and lower end with a base capable of holding the upright at its lower end in vertical position. In addition, the upright will have a means for attaching the horizontal support to it. This could be as simple as a pole that a rope could be tied to and staked in the ground but could be a more complex arrangement such as hooks, clips or the like. The uprights will also be capable of being positioned in spaced relationship to one another in order to hold the horizontal support in a horizontal position off the ground so that a target hanger will be suspended beneath the horizontal support and not be touching the ground. The uprights and supports can be of any convenient construction or shape. Materials for uprights may be selected from wood or polymeric rods, pipes, tubes or the like and the base can be of any construction design to hold the upright in an upright position.

In another embodiment of the present invention, a hook, such as a bent wire or the like, can be added to the hanger to attach items that do not fit in the provided attachment means. So, for example, a bent wire could be attached to the hanger and used to attach a soda can by threading the wire through the pop top tab.

Now referring to the drawings, FIG. 1 is five embodiments of the hanger of the present invention. FIG. 1*a* depicts a hanger 1*a* of rectangular design. It has a first end 5 and a second end 6. Each of the first end 5 and second end 6 have an open hook 10 and open hook 11. Each of the open hooks 10 and 11 are slightly different designs. This hanger 1*a* in FIG. 1*a* has horizontal support hanging means at both ends so that the hanger can be hung downwardly from such support by either the first or second ends 5 and 6. The embodiment depicted in FIG. 1*a* shows eleven target gripping means 12 designed to hold clay targets, balloons, paper targets or the like.

Figure 1B:
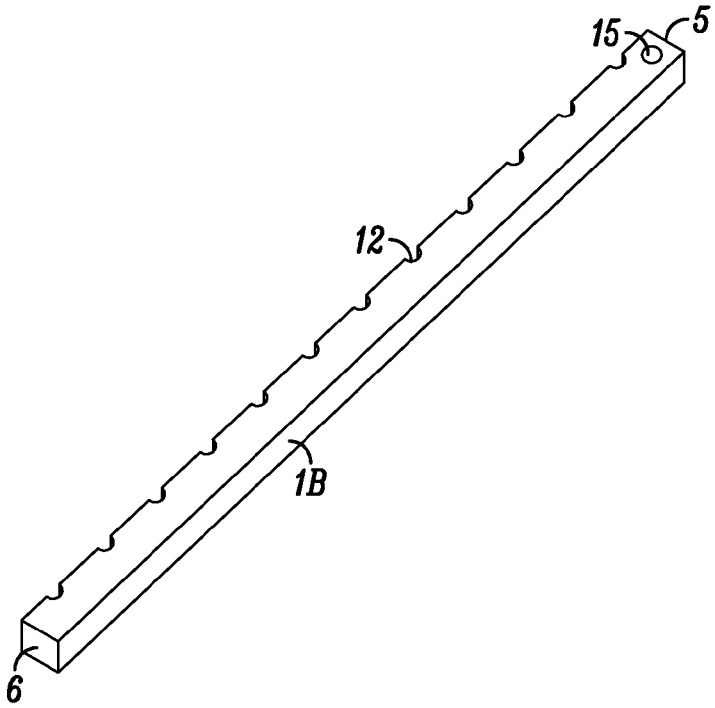
Figure 1C:
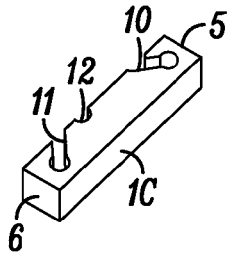

In FIG. 1*b* another hanger 1*b* is depicted. In this embodiment the support attachment means is a cord hole 15 which can be used to thread a cord or rod through to support the hanger. Once again the target gripping means 12 are shown. FIG. 1*c* on the other hand depicts a hanger 1*c* that supports one shooter's target on single target gripping means 12. This hanger 1 is relatively short since it only needs to accommodate a single target.

Figure 1D:
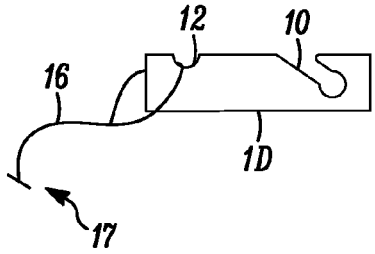

In FIG. 1*d* there is shown another hanger 1 that attaches to a horizontal support by open hook 10 and has attachment means 12. In this view additional bent wire hook 16 is attached to the hanger 1*d* so that other targets like soda cans can be hung from the hanger 1*d*.

Figure 1E:
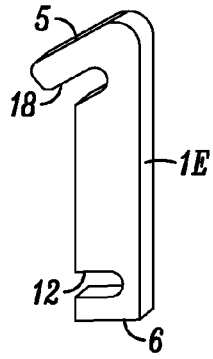

In FIG. 1*e* there is depicted hanger 1*e* having the first end 5 a lobe containing the open hook. The lobe allows for a larger hook while still keeping the shaft relatively thin. While these embodiments all depict a unitary construction, rigidly attached pieces forming the hanger could also be contemplated.

Figure 2A:
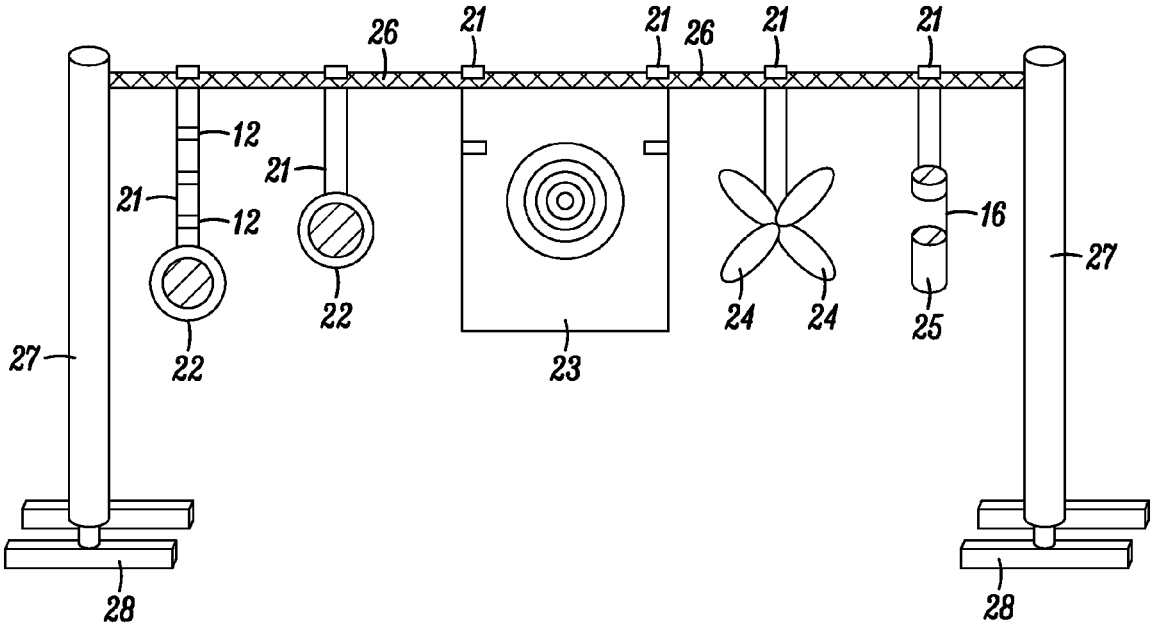

In FIG. 2*a* there is depicted the system of the present invention with the addition of the vertical uprights. In this view a number of hangers 21 of various lengths and various numbers of target attachment means are depicted. Hung downwardly from the hangers 21 are various targets including clay targets 22, paper targets 23, balloons 24 and soda cans 25. The horizontal support 26 is shown in this embodiment as a taut rope but a rod or other horizontal structure is certainly contemplated and exampled by the drawing.

FIG. 2*a* depicts a pair of uprights 27 shown in this embodiment as a pair of plastic tubes or posts. The uprights 27 are usable with or without bases 28 and are held in an upright position by bases 28 in this view. They are positioned in spaced apart manner in order to hold the rope 26 in an essentially horizontal and taut configuration over the ground such that the hangers 21 may hold their respective targets off the ground.

Figure 2B:
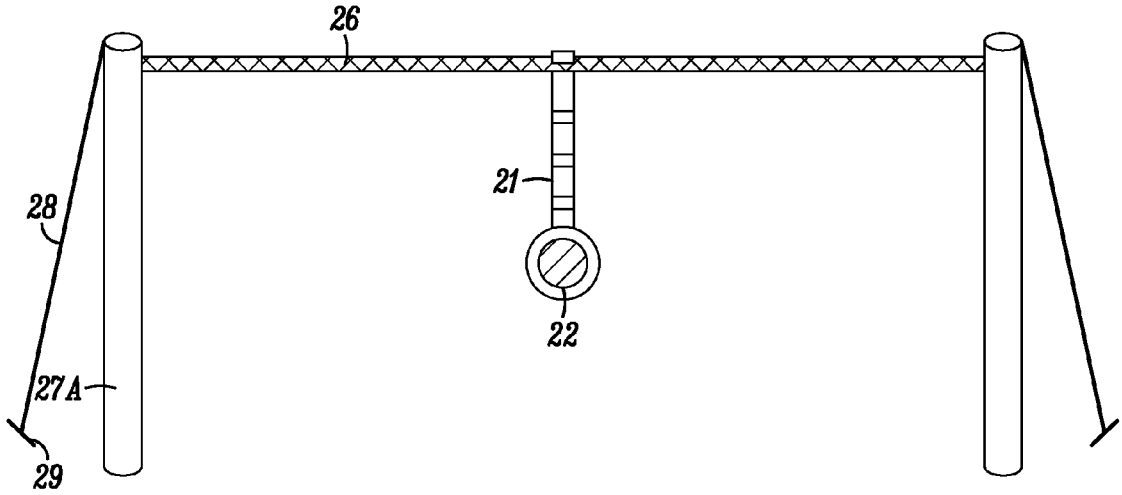
FIG. 2*b* is a frontal view of a version of the target holding system with tent poles, guide ropes and tent stakes.

FIG. 2*b* depicts another pair of uprights 27*a*, which in this view are tent poles held in place by guide ropes 28 that are held in the ground by stakes 29.

Figure 3:
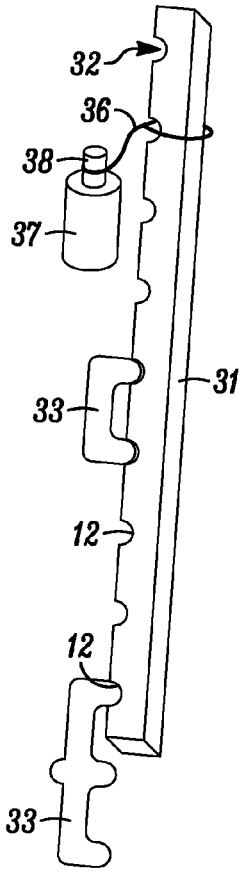
FIG. 3 is a side view showing the attachment of clay targets and use of removable hanger to hang a tin can.

FIG. 3 depicts a perspective side view of a hanger 31. The hanger 31 has a horizontal support open hook 32 and a plurality target gripping means 12. Shown mounted in the gripping means 12 are clay disks 33 shown in a side perspective; however, the face of the clay target 33 would normally face the shooter more, as depicted in FIG. 2. Also shown is a wire add on hanger, which has a soda can 37 hung by its pop top tab 38.

Other embodiments including choice of materials, shapes, configurations and the like are evident from the drawings and descriptions contained herein. Nothing therefore in the claims which follow is intended to be limited by the drawings or the like.

What is claimed is:

1. A target positioning system comprising:

a) at least one shooter's round clay target having a circumferential lip of a selected thickness perpendicular to a major face of the target; and b) a hanger adapted to suspend the shooter's round clay target from a horizontal support comprising:

i. an elongated shaft of unitary rigid resilient polymeric construction having a first end and a second end;

ii. a horizontal support attachment means consisting of a means in the shaft for suspending the hanger from the horizontal support positioned in at least one end of the shaft;

iii. a means for gripping the clay target consisting of one or more fixedly open C shaped openings in the shaft of a size adapted to accept the lip of the target and hold the target in a fixed manner, such that at least a portion of the C opening grips the target lip by forming a compressive force of the rigid resilient polymer directly on the lip placed in the C opening, the gripping means positioned in the shaft at a position selected from the group of positions consisting of in the shaft, in between the first and second end; and in the shaft at an end of the hanger not being used to suspend the hanger from the horizontal support; the gripping means C shape opening positioned in the shaft such that when the hanger is hung from a horizontal support by the attachment means the C shape opening is perpendicular to the horizontal support; and iv. the hanger comprising at least a first and second target gripping means spaced such that upon the first target gripping means gripping the lip of the clay target in a first position the second target gripping means can grip an opposite lip of the clay target at the same time.

2. A system according to claim 1 wherein there is a horizontal support attachment means at both the first and second ends positioned so that the hanger could be hung from a horizontal means by either attachment means.

3. A system according to claim 1 which further comprises a removable attachable target hanging hook attached to one of the target gripping means.

4. A system according to claim 1 which further comprises a horizontal support.

5. A system according to claim 4 wherein the horizontal support is a rope.

* * * * *